US005492224A

United States Patent [19]

Singleton, Jr.

[11] Patent Number: 5,492,224

[45] Date of Patent: Feb. 20, 1996

[54] APPARATUS AND METHOD FOR EXTRACTING IMPURITIES FROM A PULPOUS SLURRY

[76] Inventor: Robert Singleton, Jr., 1960 Paddock Ct., Lawrenceville, Ga. 30243

[21] Appl. No.: 257,006

[22] Filed: Jun. 8, 1994

[51] Int. Cl.[6] ..... B04C 3/04

[52] U.S. Cl. ..... 209/210; 209/725; 210/294; 210/787

[58] Field of Search ..... 209/2, 12.1, 208, 209/210, 459, 724, 725, 733, 734; 210/294, 512.1, 787, 788; 162/55

[56] References Cited

U.S. PATENT DOCUMENTS

| | | | |
|---|---|---|---|
| 3,452,862 | 7/1969 | Amadon et al. | 209/2 |
| 3,662,885 | 5/1972 | Dorph | 209/210 X |
| 4,280,902 | 7/1981 | Jacobsen et al. | 209/733 X |
| 4,316,768 | 2/1982 | Coddard | 162/336 |
| 4,952,314 | 8/1990 | Henricson et al. | 210/404 |
| 5,009,796 | 4/1991 | Petrik et al. | 210/787 |
| 5,124,049 | 6/1992 | Maness | 210/715 |
| 5,186,823 | 2/1993 | Robinson | 210/197 |

FOREIGN PATENT DOCUMENTS

| | | | |
|---|---|---|---|
| 1479103 | 5/1989 | U.S.S.R. | 209/733 |

*Primary Examiner*—William E. Terrell
*Assistant Examiner*—Tuan Nguyen
*Attorney, Agent, or Firm*—Kennedy & Kennedy

[57] ABSTRACT

An apparatus (10) for extracting impurities from a pulpous slurry. The apparatus has an upper housing (11), a conical, lower housing (12) and an auxiliary chamber (13). The upper housing has a separation chamber (27) having an upper shell entry portion (31) for causing a first stream of slurry to rotate within the separation chamber and a lower shell entry portion (35) for causing a second stream of slurry to rotate within the separation chamber in a direction opposite to the first stream. The rotation of the streams causes heavy impurities to collect along the outermost portion of the separation chamber. The opposite directions of rotation causes a generally stagnant zone between the rotating streams.

9 Claims, 3 Drawing Sheets

APPARATUS AND METHOD FOR EXTRACTING IMPURITIES FROM A PULPOUS SLURRY

TECHNICAL FIELD

This invention relates to apparatuses and a method for extracting impurities from a pulpous slurry.

BACKGROUND OF THE INVENTION

Generally, paper is manufactured by pouring a pulpous slurry over a fine screen so that liquids within the slurry are drained through the screen thus leaving a matt of pulp fibers thereon. The pulp matt is then pressed to squeeze out any remaining liquid and compress the pulp fibers closer together to form a firm sheet. The sheet is then treated to produce a smooth glossy surface.

To obtain the pulpous slurry trees are harvested, debarked and shipped as logs to a grinding facility. The logs are ground between grindstones to dissociated the wood fibers from each other. Through this process however impurities are collected with the pulp, such as teeth from the saws that cut the trees, metal flakes from the debarker, bits of bark, sand, dirt, plastic and other foreign particles from machinery used to process the logs. These impurities must be removed from the pulpous slurry prior to the slurry being passed through the fine screen, otherwise, they would be embedded within the finished paper making it unacceptable for use. As an alternative to grinding the logs may be chemically broken down into pulp fibers. Also, as an alternative to obtaining pulp from harvested trees finished paper may be recycled by breaking in down into pulp again. Nevertheless, with these alternative methods impurities must still be removed from the pulp fibers.

It is well known that impurities are extracted from the pulpous slurry by screens, hydrocyclones or a combination of screens and hydrocyclones. Because these impurities are usually small, their removal by screening alone is not very effective. Therefore, hydrocyclones are often used to extract impurities. Hydrocyclones may be used in series, commonly referred to as a cascade, to increase the percentage of impurities removed while attempting to prevent the waste of acceptable pulp fibers inadvertently expelled with the impurities through their recapture by another hydrocyclone coupled downstream.

Hydrocyclones typically have a conical housing with a reject tip on its lower end, an inlet pipe mounted at an upper end of the conical housing and an accept pipe mounted centrally within the housing. The inlet pipe is mounted generally tangential to the conical housing so that the slurry entering the housing is forced to rotate about the accept pipe towards the reject tip. The rapid rotation of the slurry causes the lighter particles to accumulate at the center with the heavier particles accumulating about the periphery due to the centrifugal forces acting on the particles. The majority of the pulp fibers is expelled from the hydrocyclone through the accept pipe. The majority of the heavy impurities sink to the bottom of the conical housing and are expelled through the reject tip. Because many impurities have similar densities to that of the acceptable pulp fibers, they often must be passed through hydrocyclones several times for their removal.

Another problem which commonly occurs with hydrocyclones is that large, solid objects such as rocks often enter the hydrocyclone which eventually block or clog the reject tip. Also, impurities which are embedded within large clumps of pulp fibers are not effectively extracted from the clumps of pulp.

Accordingly, it is seen that a need remains for a more efficient apparatus for extracting impurities from a pulpous slurry. It is to the provision of such therefore that the present invention is primarily directed.

SUMMARY OF THE INVENTION

In a preferred form of the invention an apparatus for extracting impurities from a pulpous slurry comprises a separation chamber that has a generally annular side wall about an upright central axis. First conduit means are provided for introducing a first stream of the slurry into a lower portion of the chamber so as to cause the first stream to flow about the chamber axis in one direction. Second conduit means are provided for introducing a second stream of the slurry into an upper portion of the chamber so as to cause the second stream to flow about the chamber axis in a direction generally opposite to the one direction. The apparatus also has third conduit means for extracting impurities from the central portion of said chamber located between the upper and lower portions where impurities collect in a relatively stagnant zone.

DETAILED DESCRIPTION

Figure 1:
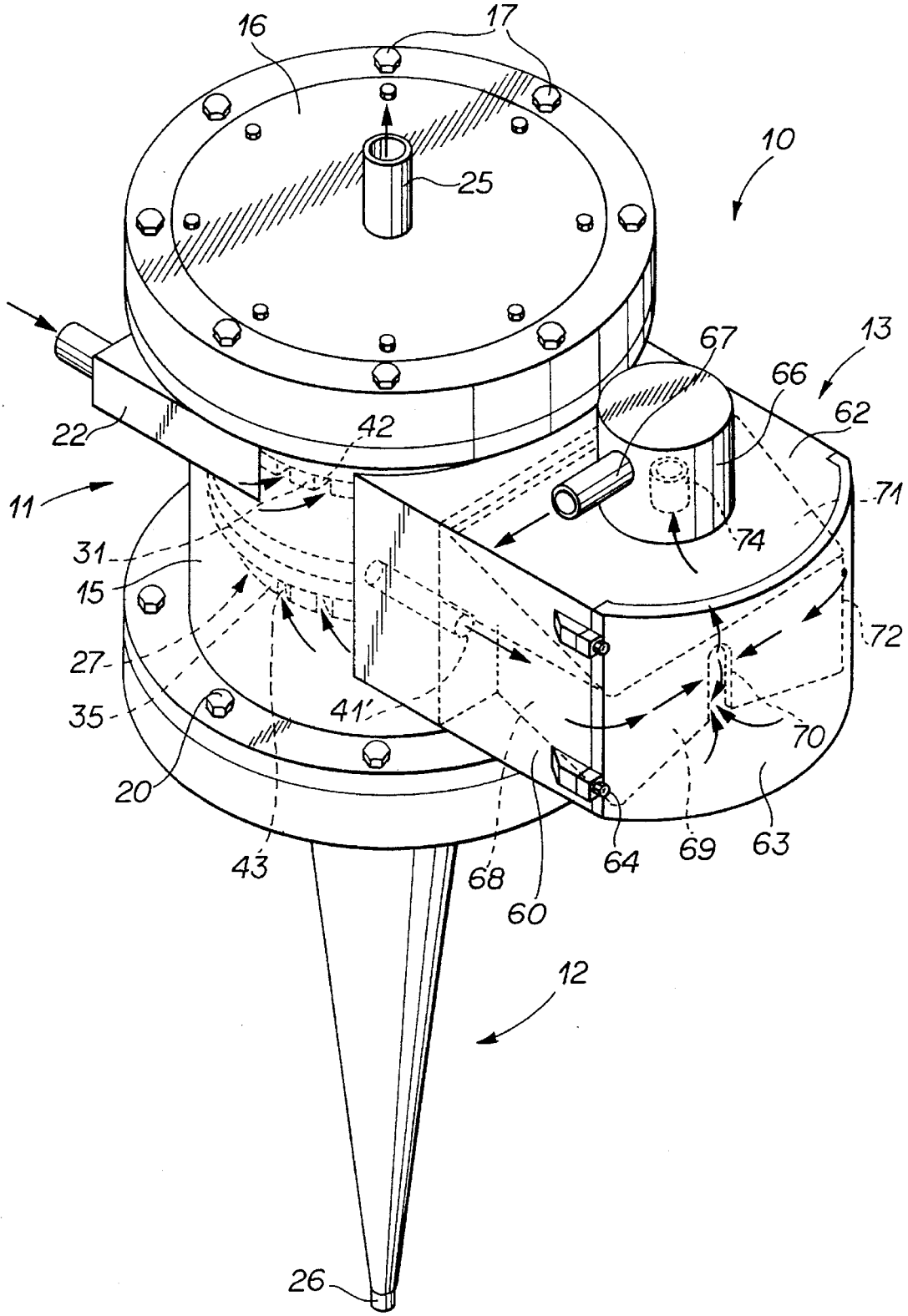
FIG. 1 is a perspective view of an apparatus for extracting impurities from a pulpous slurry embodying principles of the invention in a preferred form.

With reference to the drawings, there is shown an apparatus 10 for extracting impurities from a pulpous slurry. The apparatus 10 has a generally cylindrical upper housing 11, a conical lower housing 12 depending from the upper housing 11, and an auxiliary chamber 13 mounted to the upper housing.

The upper housing 11 has a tubular side wall 15, an annular upper cap 16 mounted to the top of the side wall 15 and secured thereto by bolts 17, and an annular bottom cap 19 mounted to the bottom of the side wall 15 and secured thereto by bolts 20. The upper housing 11 also has an upper intake manifold 22 and a lower intake manifold 23. An accept tube 25 is positioned within the upper housing 11 along the longitudinal axis of the cylindrical side wall 15 so as to extend through the upper cap 16 and depend axially within the lower housing 12. The lower housing 12 has a reject tip 26 forming the lower end. An unshown collection tube may be mounted to the reject tip.

Figure 3:
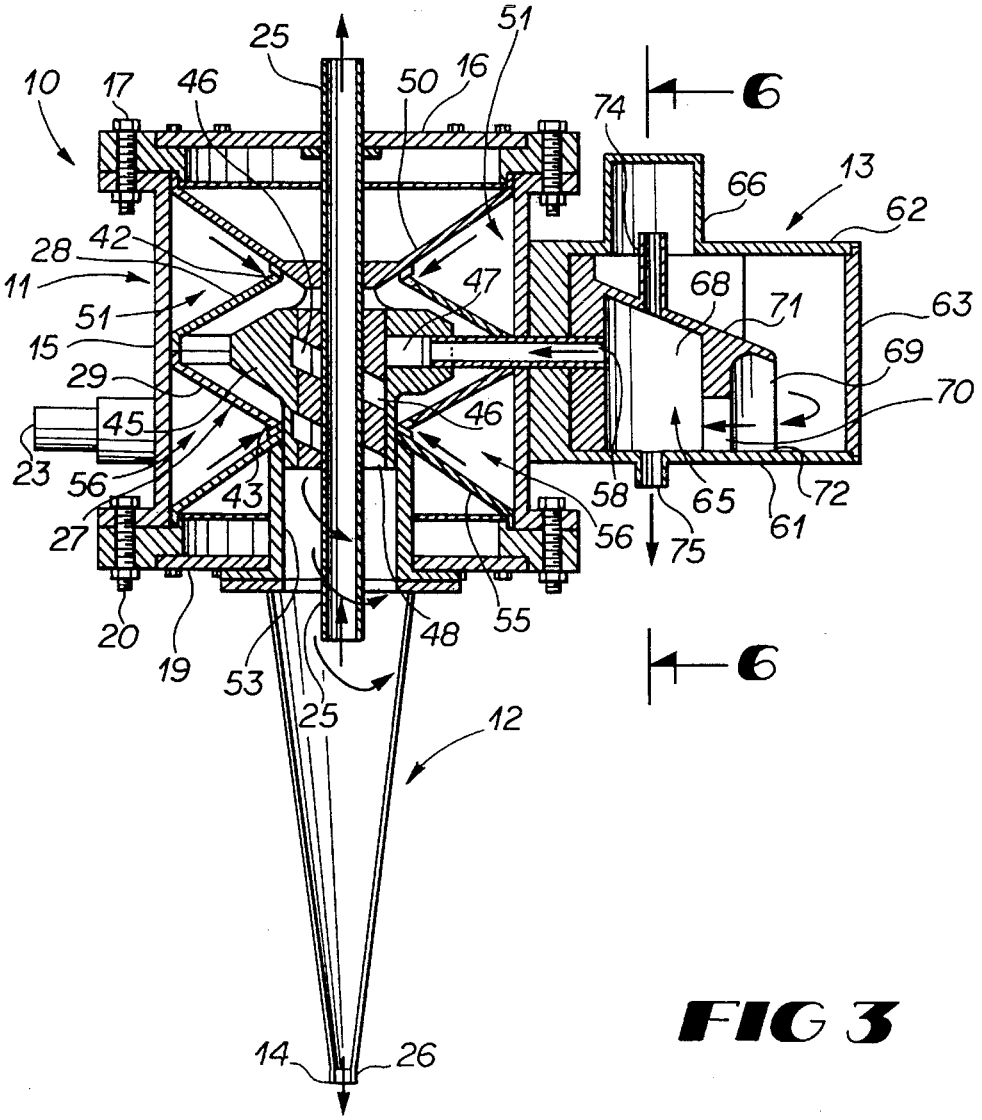
FIG. 3 is a cross-sectional view of the apparatus of FIG. 1 taken along plane 3—3 of FIG. 2.
Figure 5:
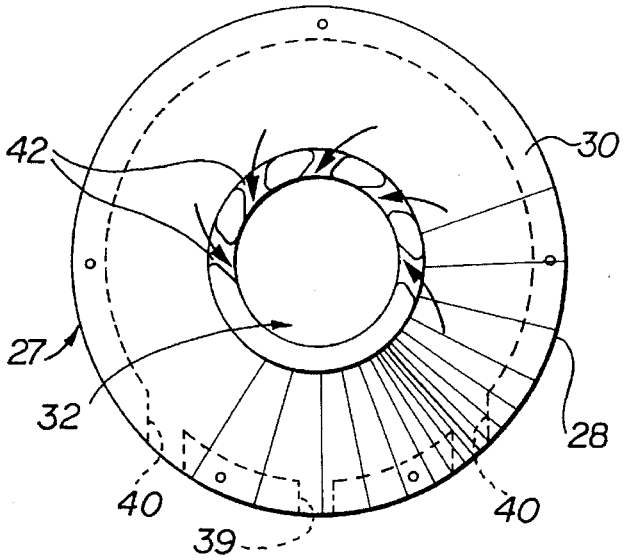
FIG. 5 is a top view of a separation chamber of the apparatus of FIG. 1.
Figure 4:
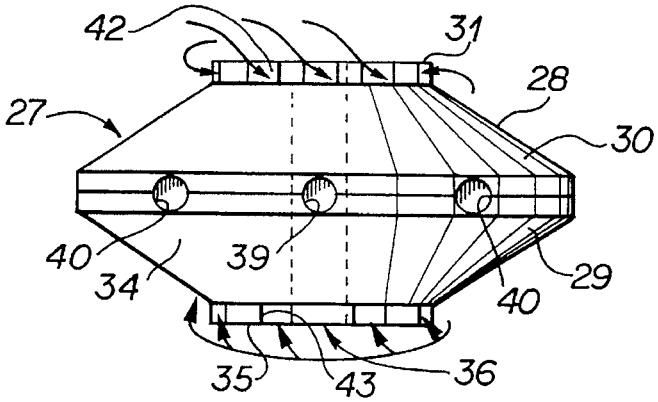
FIG. 4 is a front elevational view of a separation chamber of the apparatus of FIG. 1.
Figure 6:
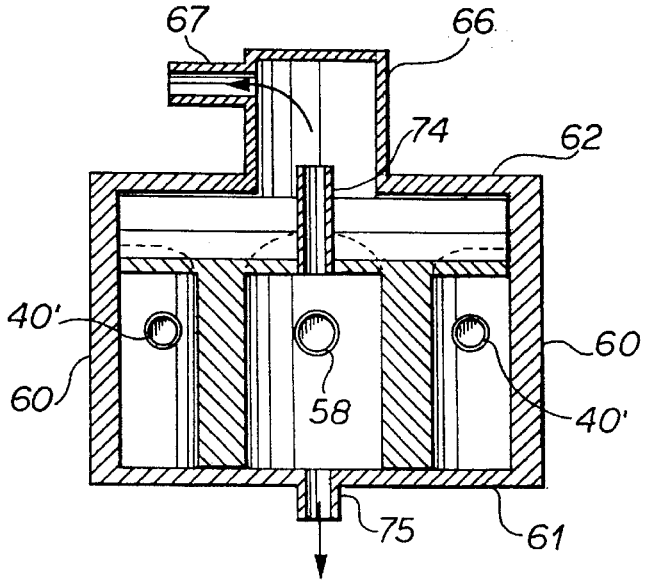
FIG. 6 is a cross-sectional view of an auxiliary chamber of the apparatus of FIG. 1 taken along plane 6—6 of FIG. 3.

A separation chamber 27 is mounted axially within the upper housing and about accept tube 25. As best shown in FIGS. 3 and 4, the separation chamber 27 is comprised of an upper shell 28 and a lower shell 29 sized and shaped to conform with the upper shell 28 about their periphery. The upper shell 28 has a truncated conical portion 30 and an annular, entry portion 31 having a central opening 32 therethrough. Likewise, the lower shell 29 has a truncated conical portion 34 and an annular, entry portion 35 having a central opening 36 therethrough. The upper and lower shells each have three semi-circular channels which form a circular, central, inlet port 39 and two circular, outer, outlet ports 40 when the shells are positioned together. As best shown in FIG. 5, the upper shell entry portion 31 has five entry channels 42 extending therethrough at an oblique angle with respect to a radial extending from the axis of the upper housing 11. Similarly, the lower shell entry portion 35 has five entry channels 43 extending therethrough at an oblique angle with respect to a radial extending from the axis of the upper housing 11. A central manifold 45 is mounted within the upper and lower shells 28 and 29 and about the accept tube 25. The central manifold 45 has a generally helical passage 46 therethrough commencing at inlet 47 and terminating at outlet 48.

A generally frustum-shaped spacer 50 is mounted within the upper housing 11 with its narrow end extending through the upper shell central opening 32 into abutment with the upper shell so as to form an annular, upper channel 51 therebetween. The upper channel 51 is in fluid communication with the interior of the separation chamber 27 through entry channels 42. A generally cylindrical tube 53 extends from a lower portion of the central manifold 45 to the conical lower housing 12. Another generally frustum-shaped spacer 55 is mounted within the upper housing 11 in abutment with the lower shell 29 so as to form an annular, lower channel 56 therebetween. The lower channel 56 is in fluid communication with the interior of the separation chamber 27 through entry channels 43. An entry tube 58 coupled to the inlet 47 of helical passage 46 extends through the upper housing 11 and central inlet port 39.

The auxiliary chamber 13 has side walls 60, a bottom wall 61, a top wall 62 and an end wall 63 removably mounted to the side walls 60 by bolts 64. The outlet ports 40 of the separation chamber continue through the auxiliary chamber as outlet ports 40'. The auxiliary chamber 13 has an inner chamber 65, a cylindrical waste chamber 66 extending from top wall 62 and a waste tube 67 extending from the waste chamber 66. The inner chamber 65 is defined by inner chamber side walls 68, inner chamber end walls 69 having a central passage 70 therethrough, an inner chamber top wall 71 and a portion of the auxiliary chamber bottom wall 61. The intersection of the inner chamber side walls 68 with the inner chamber end walls 69 form corners 72. A top outlet tube 74 extends from the inner chamber top wall 71 into the waste chamber 66. A bottom reject tip 75 extends from the bottom wall 61 of the auxiliary chamber and inner chamber. The outlet tube 67 may be coupled to an unshown collection tube. The inner chamber 13 is in fluid communication with the central manifold 45 through entry tube 58.

In use, a pulpous slurry flow is bifurcated into two streams prior to entering the apparatus 10. The flow rate of the slurry entering the apparatus is preferably between 115 to 150 gallons per minute. One stream is passed through the upper, intake manifold 22 into the upper channel 51. The other stream is passed through the lower, intake manifold 23 into the lower channel 56. The stream within the upper channel 51 is forced by fluid pressure through the entry channels 42 of entry portion 31 into an upper, interior portion of the separation chamber 27. The oblique angle of the entry channels 42 causes the stream to circulate within the chamber in a counterclockwise direction about the accept tube and central manifold. Simultaneously, the stream within the lower channel 56 is likewise forced through the entry channel 43 of entry portion 35 into the lower, interior portion of the separation chamber 27. Here the oblique angle of the entry channels 43 causes the stream to circulate within the chamber 27 in a clockwise direction about the accept tube and central manifold. The rotary flow of the streams causes clumps of pulp to break-up thus freeing any impurities bound therein. The rotation of the streams also causes impurities which are heavier than pulp fibers, i.e. having a specific gravity greater than that of pulp, to move outward and gather adjacent the periphery of the upper and lower shells 28 and 29. The opposite directions of the stream flows causes a generally stagnant zone to occur between the two streams in a zone generally located about a horizontal plane at the junction of the two shells. The term "stagnant zone" is meant to describe an area wherein the pulp is not rotationally moving. By having the entry channels 42 and 43 positioned about only one half of the entry portions 31 and 35, respectively, the flow rate of the slurry entering the separation chamber is maintained at a low enough level to eliminate or at least reduce the possibility of clogging the channels.

As the slurry streams enter the separation chamber a proportionate volume of slurry is forced from the chamber through outlet ports 40. The stream which is forced through ports 40 is comprised of a combination of heavy impurities, light impurities and pulp fibers. The heavy impurities tend to move through the ports 40 along the port walls while the pulp and light impurities move through the center of the ports. The pulp and light impurities also move through the ports at a higher rate of speed than that of the heavy impurities. These flow dynamics maintain significant separation of the heavy impurities from the pulp fibers as they travel through the common ports.

Figure 2:
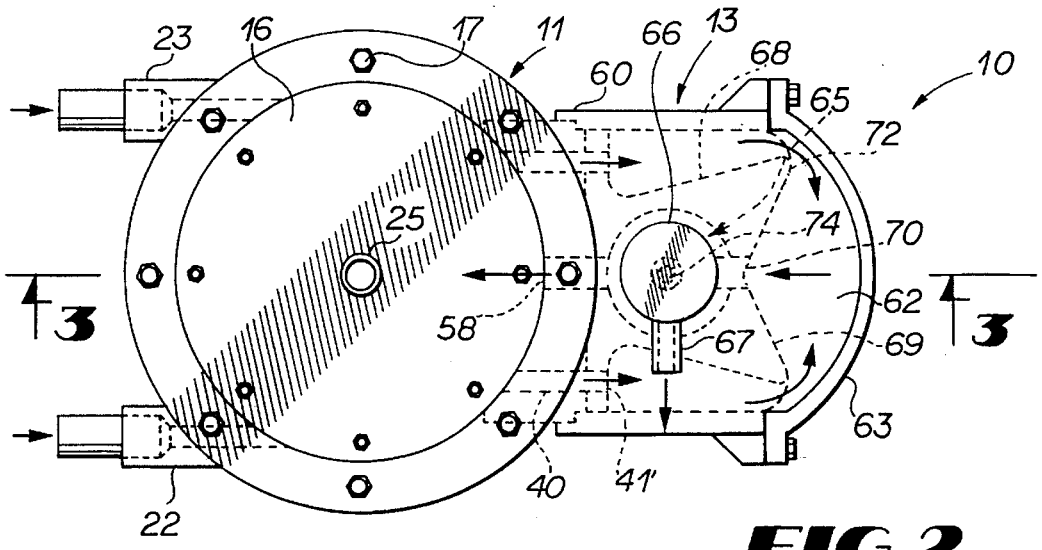
FIG. 2 is a top view of the apparatus of FIG. 1.

The slurries are passed from the outlet ports 40' into the interior of the auxiliary chamber 13 where they enter the auxiliary chamber between the auxiliary chamber side walls 60 and the inner chamber side walls 68, as indicated by the arrows in FIGS. 1 and 2. As the slurries flow about corners 72 their flow rates immediately decrease as a result of the enlarging space of travel between the auxiliary chamber end wall 63 and the inner chamber end wall 69. This decrease in the flow rate allows the light and heavy impurities to separate further from the pulp fibers due to the differences in their specific weight. Hence, light impurities, those having a specific weight less than that of pulp such as plastics and inks, and the 10 majority of air within the slurry, flow upward into waste chamber 66. These light impurities are expelled from the waste chamber through waste tube 67. Heavy impurities, those having a specific weight greater than that of the pulp such as metal particles, sand and dirt, sink to the bottom of the auxiliary chamber wherein they flow through passage 70 into inner chamber 65. The pulp fibers also flow through passage 70 into inner chamber 65.

Once within the inner chamber 65, any remaining light impurities and air flow toward the top of the inner chamber and into the waste chamber 66 through top outlet tube 74. The heavy impurities are expelled from the inner chamber through bottom reject tip 75. The pulp and any remaining impurities are conveyed from the inner chamber through entry tube 58 into the helical passage 46 of central manifold 45. The helical passage 46 causes the slurry to rotate about accept tube 25 as it exits outlet 48, as indicated by the arrows in FIG. 3. Rotation of the slurry within the conical, lower housing 12 is generally that of a conventional hydrocyclone. Therefore, any heavy impurities sink to the bottom of the lower housing and are removed through reject tip 26. The pulp fibers are conveyed from the lower housing 12 through accept tube 25.

It should be understood that several apparatuses 10 may be used in a cascade series through the use of the unshown collection tubes so that any pulp which may also be expelled from the apparatus with the impurities through reject tips 26 and 75 and waste tube 67 may be recovered by another like apparatus coupled downstream. Also, two different pulpous slurries may be introduced into the apparatus through the intake manifolds 22 and 23 rather than a single, bifurcated slurry. This allows for a slurry of long pulp fibers to be combined with a slurry of short pulp fibers within the apparatus, as previously these would have to be brought together in a tank previous to separation. Similarly, a slurry of virgin pulp may be combined with a slurry of recycled pulp.

Solid objects which are drawn into the apparatus are collected within the upper channel 51 or lower channel 56. These objects may be removed and the apparatus cleaned by unthreading bolts 17 and 20, removing upper cap 16 and bottom cap 19, and removing cone-shaped spacers 50 and 55. The solid object may then be removed from the apparatus. Obviously, only one cap and spacer need be removed for quickly removing an object. If desired the separation chamber 27 may be cleaned further by removing the upper shell 28 and lower shell 29 from the upper housing 11. The auxiliary chamber 13 may be cleaned by unthreading bolts 64 and removing end wall 63.

From the foregoing it is seen that an apparatus for extracting impurities from a pulpous slurry is now provided which overcomes problems associated with those of the prior art. It should be understood however that the just described embodiment merely illustrates principles of the invention in its preferred form. Many modifications, additions and deletions may be made thereto without departure from the spirit and scope of the invention as set forth in the following claims.

I claim:

1. Apparatus for extracting impurities from pulp fibers of a pulpous slurry, comprising, a separation chamber having generally annular side walls about an upright central axis; first conduit means comprised of at least one passage extending through said chamber side walls at an oblique angle with respect to a radial extending from said chamber axis for introducing a first stream of the slurry into a lower portion of said chamber so as to cause the first stream to flow about said chamber axis in one direction, second conduit means for introducing a second stream of the slurry into an upper portion of said chamber so as to cause the second stream to flow about said chamber axis in a direction generally opposite to said one direction whereby the opposite directions of the first and second streams causes impurities to separate from pulp fibers within the pulpous slurry, and third conduit means for extracting the pulpous slurry from a central portion of said chamber located between said upper and lower portions where impurities collect in a relatively stagnant zone.

2. The apparatus of claim 1 wherein said second conduit means is comprised of at least one passage extending through said chamber side walls at an oblique angle with respect to a radial extending from said chamber axis and opposite to said first conduit means passage.

3. Apparatus for extracting impurities from pulp fibers of a pulpous slurry, comprising, a separation chamber having generally annular side walls about an upright central axis; first conduit means for introducing a first stream of the slurry into a lower portion of said chamber so as to cause the first stream to flow about said chamber axis in one direction, second conduit means for introducing a second stream of the slurry into an upper portion of said chamber so as to cause the second stream to flow about said chamber axis in a direction generally opposite to said one direction whereby the opposite directions of the first and second streams causes impurities to separate from pulp fibers with the pulpous slurry; third conduit means for extracting the pulpous slurry from a central portion of said chamber located between said upper and lower portions where impurities collect in a relatively stagnant zone, an auxiliary chamber coupled to said third conduit means, fourth conduit means for extracting impurities from a lower portion of said auxiliary chamber which have a specific weight greater than a selected specific weight, fifth conduit means for extracting impurities from an upper portion of said auxiliary chamber which have a specific weight less than the selected specific weight, and sixth conduit means for extracting the pulpous slurry generally having the selected specific weight from said auxiliary chamber.

4. The apparatus of claim 3 further comprising a hydrocyclone coupled to said sixth conduit means.

5. In an apparatus for extracting impurities from pulp fibers of a pulpous slurry having a hydrocyclone with an upper housing, a conical lower housing extending from the upper housing and having an outlet nozzle mounted at the lower end thereof for conveying impurities from the lower housing, and a conveying tube mounted generally axially within the lower housing and extending through the upper housing for conveying acceptable pulpous slurry from the lower housing, the improvement comprising a separation chamber having generally annular side walls mounted within said upper housing; first conduit means for introducing a first stream of the slurry into a lower portion of said chamber so as to cause the first stream to rotate within said chamber in one direction; second conduit means for introducing a second stream of the slurry into an upper portion of said chamber so as to cause the second stream to rotate within said chamber in a direction generally opposite to said one direction thereby creating a relatively stagnant zone between the rotating streams; and third conduit means for extracting the pulp fibers and impurities within the stagnant zone.

6. The apparatus of claim 5 wherein said first conduit means is comprised of at least one passage extending through said chamber side walls at an oblique angle with respect to a radial extending from said chamber axis.

7. The apparatus of claim 6 wherein said second conduit means is comprised of at least one passage extending through said chamber side walls at an oblique angle with respect to a radial extending from said chamber axis and opposite to said first conduit means passage.

8. The apparatus improvement of claim 5 further comprising an auxiliary chamber coupled to said third conduit means, forth conduit means for extracting impurities from a lower portion of said auxiliary chamber which have a specific weight greater than a selected specific weight, fifth conduit means for extracting impurities from an upper portion of said auxiliary chamber which have a specific weight less than the selected specific weight, and sixth conduit means for extracting the pulpous slurry generally having the selected specific weight from said auxiliary chamber.

9. A method of separating impurities from pulp fibers in a slurry comprising the steps of:

(a) bifurcating the flow into upper and lower streams;

(b) channeling the upper stream into an upper portion of an upright tubular chamber in a direction to cause the upper stream to flow in one direction about the upright axis of the tubular chamber;

(c) simultaneously with step (b) channeling the lower stream into a lower portion of the upright tublar chamber in a direction to cause the lower stream to flow in about the upright axis of the tubular chamber opposite the direction of the upper stream, thereby creating a generally stagnant zone where the upper stream and lower stream merge; and (d) extracting the impurities and pulp fibers from the stagnant zone.

* * * * *